US010877420B2

(12) United States Patent
Kobayashi

(10) Patent No.: US 10,877,420 B2
(45) Date of Patent: Dec. 29, 2020

(54) IMAGE FORMING APPARATUS HAVING CORRECTION OF FOLLOWING IMAGE BASED ON DEFORMATION OF PRECEDING RECORDING MEDIUM

(71) Applicant: Yukifumi Kobayashi, Kanagawa (JP)

(72) Inventor: Yukifumi Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/782,834

(22) Filed: Feb. 5, 2020

(65) Prior Publication Data

US 2020/0264546 A1 Aug. 20, 2020

(30) Foreign Application Priority Data

Feb. 20, 2019 (JP) ..... 2019-028664

(51) Int. Cl.
*G03G 15/00* (2006.01)
*G03G 15/23* (2006.01)

(52) U.S. Cl.
CPC ..... *G03G 15/5062* (2013.01); *G03G 15/231* (2013.01); *G03G 15/235* (2013.01); (Continued)

(58) Field of Classification Search
CPC ..... G03G 15/5062; G03G 15/231; G03G 15/234; G03G 15/235; G03G 15/5095; (Continued)

(56) References Cited

U.S. PATENT DOCUMENTS 4,792,828 A 12/1988 Ozawa et al.
7,583,282 B2 * 9/2009 Yamauchi ..... G03G 15/5062 347/229

(Continued)

FOREIGN PATENT DOCUMENTS

JP 9-267531 10/1997
JP 2003241610 A * 8/2003

(Continued)

OTHER PUBLICATIONS

European Search Report; Application EP20153784; dated Jul. 21, 2020.

*Primary Examiner* — Robert B Beatty
(74) *Attorney, Agent, or Firm* — Duft & Bornsen, PC

(57) ABSTRACT

An image forming apparatus includes a conveying device, an image forming device, a reading device, and control circuitry. The conveying device sequentially conveys a plurality of successive recording media that includes a preceding recording medium and a following recording medium. The image forming device forms an image on each of a front surface and a back surface of the preceding recording medium conveyed. The reading device reads an outer shape of the preceding recording medium. The control circuitry calculates an amount of deformation of the preceding recording medium based on the outer shape of the preceding recording medium read. The control circuitry corrects at least one of a front image and a back image based on the amount of deformation calculated, to cause the image forming device to form the front image and the back image on a front surface and a back surface, respectively, of the following recording medium.

9 Claims, 10 Drawing Sheets

(52) U.S. Cl.
CPC . *G03G 15/5095* (2013.01); *G03G 2215/0059* (2013.01); *G03G 2215/0485* (2013.01)

(58) Field of Classification Search
CPC ..... G03G 15/6588; G03G 2215/00586; G03G 2215/0059; G03G 2215/0485
USPC ..... 399/45, 389, 364, 401
See application file for complete search history.

(56) References Cited

U.S. PATENT DOCUMENTS

| | | | | |
|---|---|---|---|---|
| 2005/0008406 | A1 | 1/2005 | Nishizaki | |
| 2010/0157326 | A1 | 6/2010 | Mori | |
| 2010/0225932 | A1* | 9/2010 | Kurose | G03G 15/234 358/1.1 |
| 2011/0134178 | A1* | 6/2011 | Chiwata | B41J 11/0015 347/14 |
| 2013/0155428 | A1* | 6/2013 | Mizuno | B41J 11/008 358/1.9 |
| 2013/0195482 | A1 | 8/2013 | Nakura et al. | |
| 2014/0029961 | A1 | 1/2014 | Ueda et al. | |
| 2014/0118762 | A1 | 5/2014 | Nakura et al. | |
| 2015/0063889 | A1 | 3/2015 | Kojima | |
| 2015/0151938 | A1 | 6/2015 | Matsumoto et al. | |
| 2015/0378297 | A1 | 12/2015 | Nakura et al. | |
| 2016/0090256 | A1 | 3/2016 | Nakayama et al. | |
| 2016/0221780 | A1 | 8/2016 | Nishimura et al. | |
| 2019/0171137 | A1 | 6/2019 | Kobayashi | |
| 2019/0171154 | A1 | 6/2019 | Kobayashi et al. | |

FOREIGN PATENT DOCUMENTS

| | | | |
|---|---|---|---|
| JP | 2005-017422 | | 1/2005 |
| JP | 2006-030451 | | 2/2006 |
| JP | 2006-264900 | | 10/2006 |
| JP | 2007072094 | A * | 3/2007 |
| JP | 2011-121237 | | 6/2011 |
| JP | 2013-053004 | | 3/2013 |
| JP | 2014119573 | A * | 6/2014 |
| JP | 2015-065647 | | 4/2015 |
| JP | 2016-180857 | | 10/2016 |
| JP | 2017-032922 | | 2/2017 |
| JP | 2017-134268 | | 8/2017 |
| JP | 2017151376 | A | 8/2017 |
| JP | 2019-101326 | | 6/2019 |

* cited by examiner

IMAGE FORMING APPARATUS HAVING CORRECTION OF FOLLOWING IMAGE BASED ON DEFORMATION OF PRECEDING RECORDING MEDIUM

CROSS-REFERENCE TO RELATED APPLICATION

This patent application is based on and claims priority pursuant to 35 U.S.C. § 119(a) to Japanese Patent Application No. 2019-028664, filed on Feb. 20, 2019, in the Japan Patent Office, the entire disclosure of which is hereby incorporated by reference herein.

BACKGROUND

Technical Field

Embodiments of the present disclosure generally relate to an image forming apparatus, and more particularly, to an image forming apparatus for forming images on front and back surfaces, respectively, of a recording medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such image forming apparatuses, typically used in the field of commercial printing, often have a function of correcting a difference between an image formed on a front surface of a recording medium and an image formed on a back surface of the recording medium by duplex printing to eliminate image misalignment between the front surface and the back surface of the recording medium.

SUMMARY

In one embodiment of the present disclosure, a novel image forming apparatus includes a conveying device, an image forming device, a reading device, and control circuitry. The conveying device is configured to sequentially convey a plurality of successive recording media. The plurality of successive recording media includes a preceding recording medium and a following recording medium conveyed after the preceding recording medium. The image forming device is configured to form an image on each of a front surface and a back surface of the preceding recording medium conveyed by the conveying device. The reading device is configured to read an outer shape of the preceding recording medium bearing the image formed by the image forming device. The control circuitry is configured to calculate an amount of deformation of the preceding recording medium based on the outer shape of the preceding recording medium read by the reading device. The control circuitry is configured to correct at least one of a front image and a back image based on the amount of deformation calculated, to cause the image forming device to form the front image and the back image on a front surface and a back surface, respectively, of the following recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
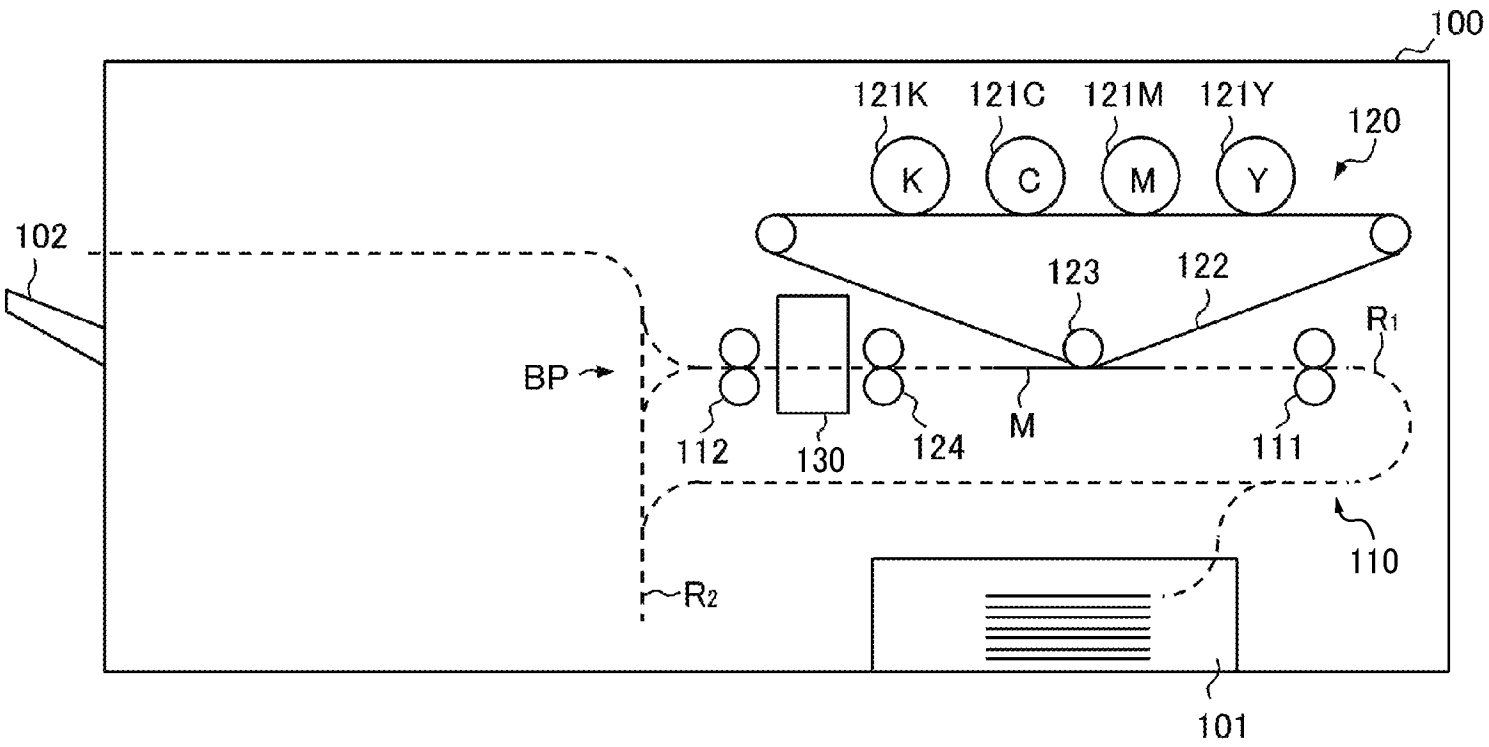
FIG. 1 is a schematic view of an image forming apparatus according to a first embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Initially with reference to FIG. 1, a description is given of a first embodiment of the present disclosure.

FIG. 1 is a schematic view of an image forming apparatus 100 according to the first embodiment of the present disclosure.

As illustrated in FIG. 1, the image forming apparatus 100 includes an input tray 101, an output tray 102, a conveying device 110, an image forming device 120, and a reading device 130. A plurality of sheets M bearing no images rests on the input tray 101. By contrast, a sheet M bearing an image rests on the output tray 102.

The sheet M is an example of a recording medium that is conveyed by the conveying device 110, imaged by the image forming device 120, and read by the reading device 130. Specifically, the reading device 130 reads an outer shape of the recording medium. The sheet M is, e.g., a sheet cut in a given size such as A4 or B5, and made of paper or cloth woven with fibers that expand and contract when an image is formed on the sheet M.

In the image forming apparatus 100, a main conveyance passage $R_1$ and a reverse conveyance passage $R_2$ are defined, as spaces, by internal components of the image forming apparatus 100. The sheet M is conveyed along or through the main conveyance passage $R_1$ and the reverse conveyance passage $R_2$. The main conveyance passage $R_1$ is a passage from the input tray 101 to the output tray 102 through the image forming device 120. The reverse conveyance passage $R_2$ is a passage that branches from the main conveyance passage $R_1$ at a junction BP downstream from the image forming device 120 in a direction of conveyance of the sheet M (hereinafter referred to as a sheet conveying direction) and that rejoins the main conveyance path $R_1$ upstream from the image forming device 120 in the sheet conveying direction.

More specifically, the reverse conveyance passage $R_2$ is a so-called switchback path to reverse front and back surfaces of the sheet M having an image on the front surface of the sheet M and direct the sheet M to the image forming device 120 again. Note that, while passing through the reverse conveyance passage $R_2$, the sheet M is reversed such that leading and trailing ends of the sheet M in the sheet conveying direction are interchanged. The sheet M thus reversed is then directed to the image forming device 120.

The conveying device 110 conveys the sheet M along the main conveyance passage $R_1$ and the reverse conveyance passage $R_2$. Specifically, the conveying device 110 conveys the sheet M from the input tray 101 to a position of the image forming device 120 along the main conveyance passage $R_1$. Thereafter, the conveying device 110 conveys the sheet M having an image on the front surface of the sheet M along the reverse conveyance passage $R_2$ to reverse the front and back surfaces of the sheet M. Then, the conveying device 110 conveys the sheet M to the position of the image forming device 120 again. Thereafter, the conveying device 110 conveys the sheet M having images on the front and back surfaces, respectively, of the sheet M along the main conveyance passage $R_1$ to eject the sheet M onto the output tray 102.

The conveying device 110 includes conveyance roller pairs 111 and 112. Each of the conveyance roller pairs 111 and 112 is constructed of, e.g., a driving roller and a driven roller. The driving roller is rotated by a driving force transmitted from a motor 119 illustrated in FIGS. 2 to 4. The driven roller, in contact with the driving roller, is driven to rotate by rotation of the driving roller. The driving roller and the driven roller sandwiches the sheet M and rotate to convey the sheet M along the main conveyance passage $R_1$ or the reverse conveyance passage $R_2$.

The conveyance roller pair 111 is disposed upstream from the image forming device 120 in the sheet conveying direction. The conveyance roller pair 112 is disposed downstream from the reading device 130 in the sheet conveying direction and upstream from the junction BP in the sheet conveying direction. In addition to the conveyance roller pairs 111 and 112, the conveying device 110 includes other conveyance rollers such as a conveyance roller or a conveyance roller pair that conveys the sheet M along the reverse conveyance passage $R_2$.

The image forming device 120 is disposed opposite the main conveyance passage $R_1$ between the conveyance roller pair 111 and the conveyance roller pair 112. The image forming device 120 forms an image on each of the front surface and the back surface of the sheet M conveyed by the conveying device 110. The image forming device 120 of the present embodiment forms an image by electrophotography on the sheet M conveyed along the main conveyance passage $R_1$.

Specifically, the image forming device 120 has a tandem structure in which drum-shaped photoconductors 121 (specifically, photoconductors 121Y, 121M, 121C, and 121K for yellow, magenta, cyan, and black, respectively) are arranged side by side along an endless conveyor belt 122. More specifically, the photoconductors 121Y, 121M, 121C, and 121K are aligned in this order along the conveyor belt 122, from an upstream side of the sheet conveying direction, which is a moving direction of the conveyor belt 122, to form an intermediate transfer image on the conveyor belt 122. The intermediate transfer image is then transferred onto the sheet M fed from the input tray 101.

On the surface of the photoconductors 121Y, 121M, 121C, and 121K, latent images are developed with respective colors of toner as colorant into yellow, magenta, cyan, and black toner images. The yellow, magenta, cyan, and black toner images are then superimposed one atop another on the conveyor belt 122, thus being transferred onto the conveyor belt 122 and forming a composite full-color toner image (i.e., intermediate transfer image) on the conveyor belt 122. A transfer roller 123 transfers the full-color image from the conveyor belt 122 onto the sheet M at a position closest to the main conveyance passage $R_1$.

In addition to the photoconductors 121, the conveyor belt 122, and the transfer roller 123, the image forming device 120 includes a fixing roller pair 124 that is disposed downstream from the transfer roller 123 in the sheet conveying direction. The fixing roller pair 124 includes a driving roller and a driven roller. The driving roller is driven by a motor. The driven roller, in contact with the driving roller, is driven to rotate by rotation of the driving roller. The driving roller and the driven roller sandwiches the sheet M and rotate to convey the sheet M bearing the full-color image transferred by the transfer roller 123, while fixing the full-color image onto the sheet M under heat and pressure.

The reading device 130 reads an outer shape of the sheet M bearing the image formed by the image forming device 120. The reading device 130 is disposed downstream from the fixing roller pair 124 in the sheet conveying direction and upstream from the junction BP in the sheet conveying direction, so as to face the main conveyance passage $R_1$. In other words, the reading device 130 is disposed where both the sheet M having an image only on the front surface of the sheet M and the sheet M having images on the front and back surfaces, respectively, pass.

Figure 2:
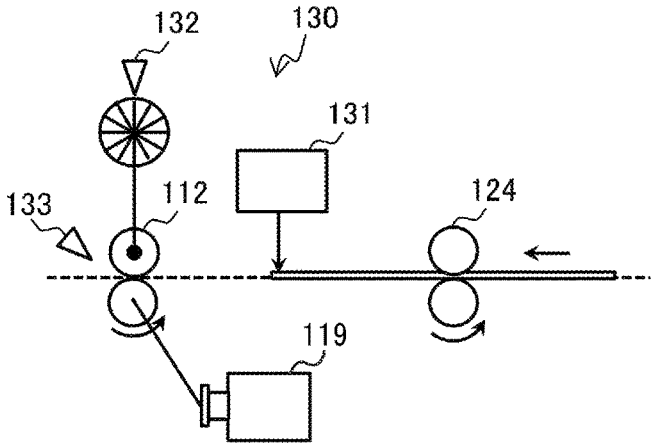
FIG. 2 is a view of a leading end of a recording medium reaching a position opposite a line sensor.
Figure 3:
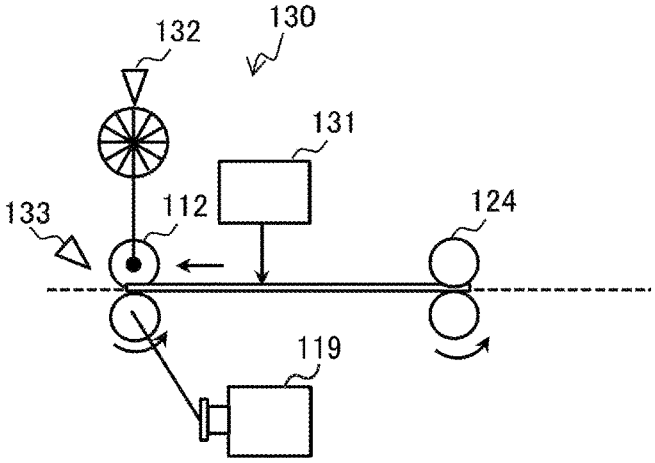
FIG. 3 is a view of the leading end of the recording medium reaching a conveyance roller pair.
Figure 4:
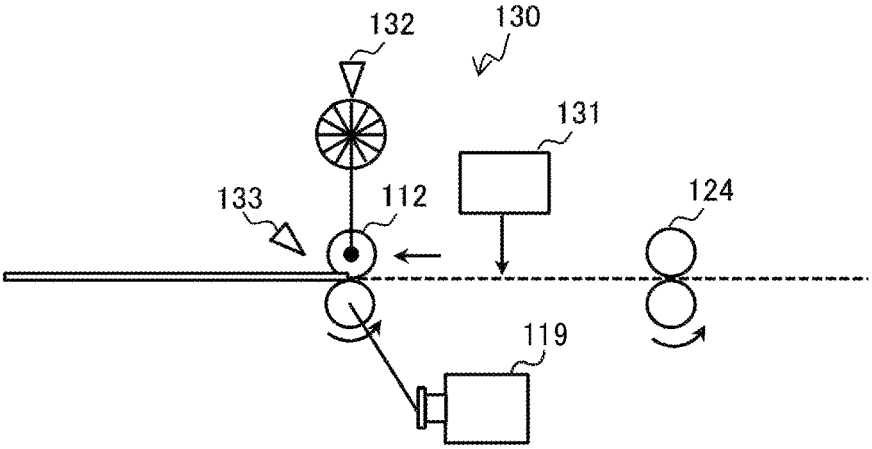
FIG. 4 is a view of a trailing end of the recording medium reaching the conveyance roller pair.

Referring now to FIGS. 2 to 4, a detailed description is given of the reading device 130.

FIG. 2 is a view of a leading end of a sheet M reaching a position opposite a line sensor 131. FIG. 3 is a view of the leading end of the sheet M reaching the conveyance roller pair 112. FIG. 4 is a view of a trailing end of the sheet M reaching the conveyance roller pair 112.

The reading device 130 of the first embodiment includes the line sensor 131, an encoder 132, and a timing sensor 133.

The line sensor 131 is constructed of a plurality of imaging elements aligned in a width direction of the sheet M (hereinafter referred to as a sheet width direction). The sheet width direction is a direction perpendicular to the direction of conveyance of the sheet M (i.e., sheet conveying direction). An area over which the plurality of imaging elements is aligned is wider than a maximum width of a sheet M that can pass through the main conveyance passage $R_1$. The line sensor 131 specifies positions, in the sheet width direction, of vertices $P_1$, $P_2$, $P_3$, and $P_4$ (illustrated in FIG. 8) of the sheet M that is conveyed by the conveying device 110. A change in luminance value is used, for example, to specify the positions of the vertices $P_1$ to $P_4$ in the sheet width direction.

The encoder 132 detects rotation of the driven roller of the conveyance roller pair 112. In other words, the encoder 132 outputs a pulse signal linked to the rotation of the driven roller to a controller 80 (illustrated in FIG. 6). A detailed description of the controller 80 is deferred. A distance over which the sheet M is conveyed by the conveyance roller pair 112 is specified by an encode value, which is a value obtained by counting the number of pulse signals.

The timing sensor 133 detects a time at which the leading end of the sheet M passes through the conveyance roller pair 112 (as illustrated in FIG. 3) and a time at which the trailing end of the sheet M passes through the conveyance roller pair 112 (as illustrated in FIG. 4). For example, the timing sensor 133 may emit light toward a position at which the sheet M is sandwiched between the driving roller and the driven roller of the conveyance roller pair 112, to detect the times described above based on a luminance value of the reflected light.

A length of the sheet M in the sheet conveying direction is specified based on an encode value between detection of the leading end of the sheet M and detection of the trailing end of the sheet M by the timing sensor 133. A detailed description with reference to FIGS. 8 and 9 of how the reading device 130 reads the outer shape of the sheet M is deferred.

Note that the specific configuration of the reading device 130 is not limited to the example illustrated in FIGS. 2 to 4. As another example, the reading device 130 may take a photograph of the sheet M between the fixing roller pair 124 and the conveyance roller pair 112 and perform image processing on the photograph to specify the outer shape of the sheet M.

Figure 5:
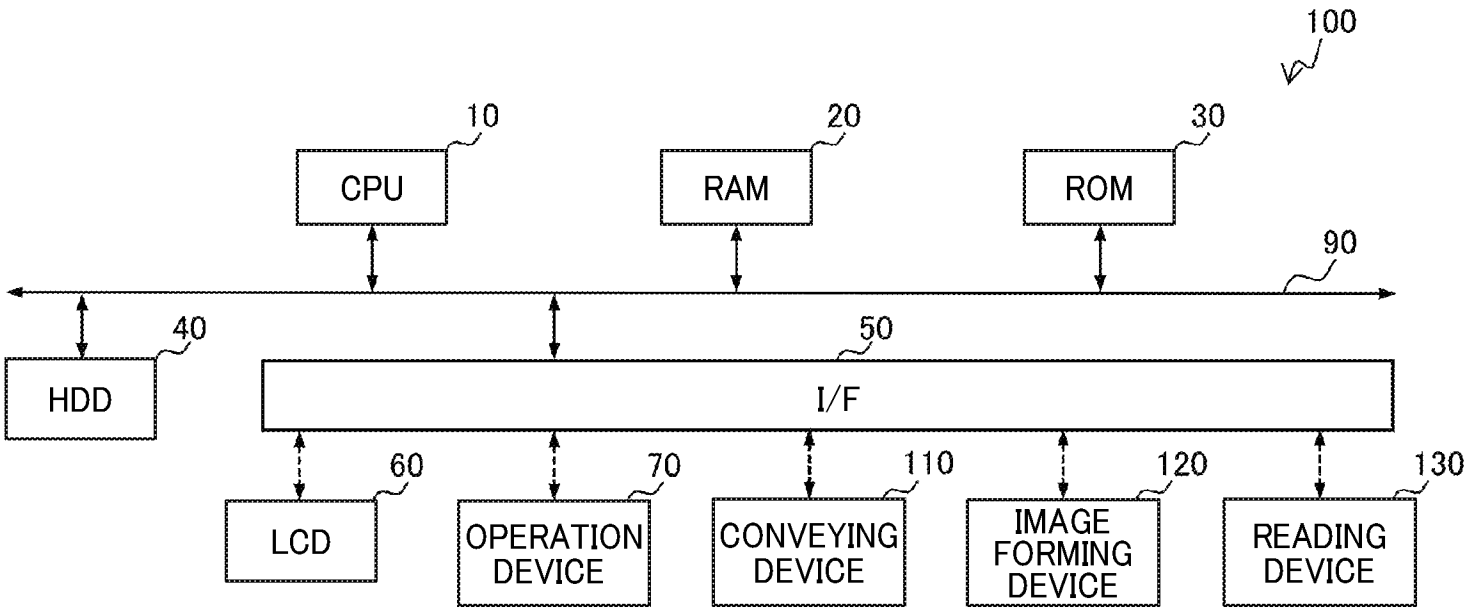
FIG. 5 is a block diagram illustrating a hardware configuration of the image forming apparatus.

Referring now to FIG. 5, a description is given of a hardware configuration of the image forming apparatus 100.

FIG. 5 is a block diagram illustrating the hardware configuration of the image forming apparatus 100.

As illustrated in FIG. 5, the image forming apparatus 100 includes a central processing unit (CPU) 10, a random access memory (RAM) 20, a read only memory (ROM) 30, a hard disk drive (HDD) 40, and an interface (I/F) 50, which are connected to each other via a common bus 90.

The CPU 10 is a calculator or computing device that controls an overall operation of the image forming apparatus 100. The RAM 20 is a volatile storage medium that allows data to be read and written at high speed. The CPU 10 uses the RAM 20 as a work area for data processing. The ROM 30 is a read-only non-volatile storage medium that stores programs such as firmware. The HDD 40 is a non-volatile storage medium that allows data to be read and written and has a relatively large storage capacity. The HDD 40 stores, e.g., an operating system (OS), various control programs, and application programs.

The image forming apparatus 100 processes, by an arithmetic function of the CPU 10, e.g., a control program stored in the ROM 30 and an information processing program (or application program) loaded into the RAM 20 from a storage medium such as the HDD 40. Such processing configures a software controller including various functional modules of the image forming apparatus 100. The software controller thus configured cooperates with hardware resources of the image forming apparatus 100 to implement functions, illustrated as functional blocks, of the image forming apparatus 100.

The I/F 50 is an interface that connects a liquid crystal display (LCD) 60, an operation device 70, the conveying device 110, the image forming device 120, and the reading device 130 to the common bus 90. The LCD 60 displays various screens that provide information to, e.g., an operator. The operation device 70 is an input interface that receives input of various types of information from the operator and includes, e.g., a push button and a touch panel superimposed on the LCD 60.

Figure 6:
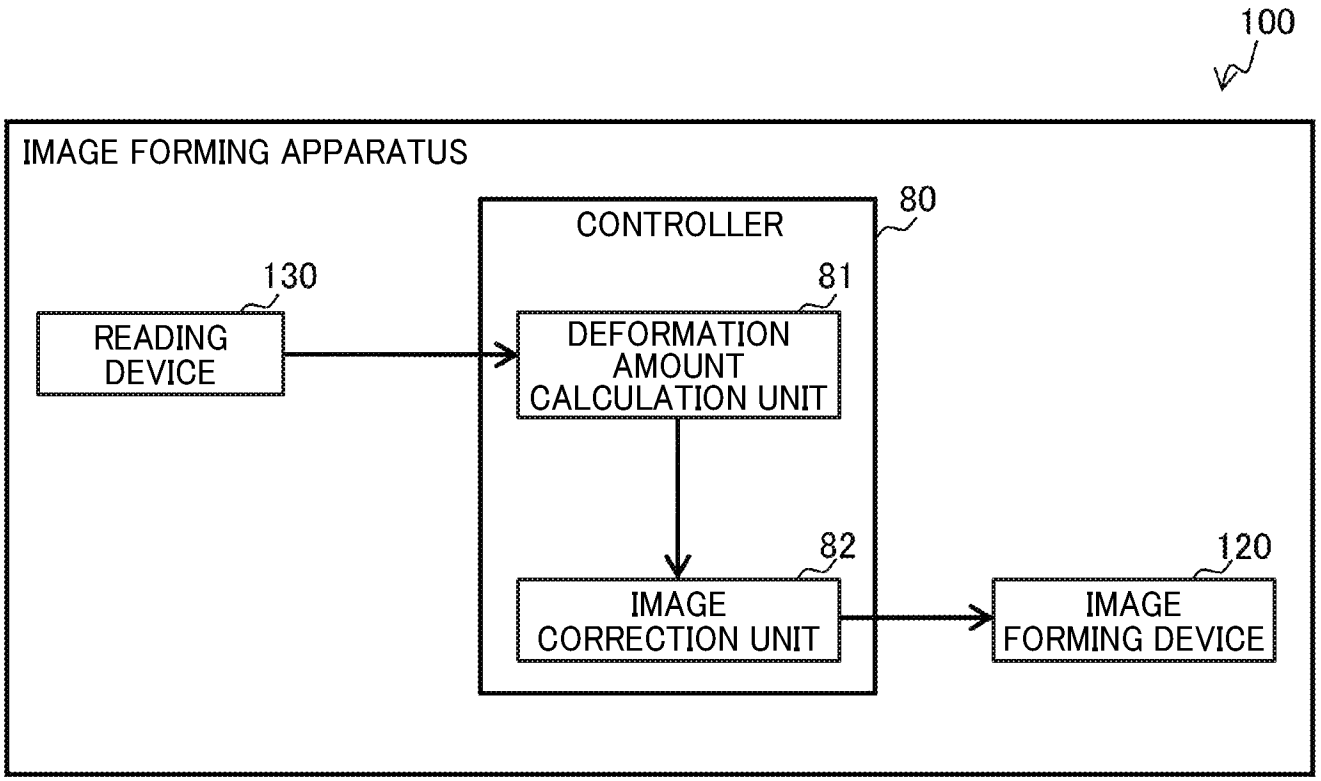
FIG. 6 is a functional block diagram of a controller of the image forming apparatus.

Referring now to FIG. 6, a description is given of functions of the controller 80 of the image forming apparatus 100.

FIG. 6 is a functional block diagram of the controller 80 of the image forming apparatus 100.

The controller 80 is implemented by, e.g., the CPU 10, the RAM 20, the ROM 30, and the HDD 40 illustrated in FIG. 5. As illustrated in FIG. 6, the controller 80 includes a deformation amount calculation unit 81 and an image correction unit 82.

When the toner transferred onto the sheet M by the transfer roller 123 is fixed by the fixing roller pair 124, the sheet M deforms, specifically, the sheet M expands and contracts in the sheet conveying direction and the sheet width direction. That is, the outer shape of the sheet M may change before and after an image is formed on the front surface of the sheet M. Similarly, the outer shape of the sheet M may change before and after an image is formed on the back surface of the sheet M. Therefore, the deformation amount calculation unit 81 calculates an amount of deformation of the sheet M based on the outer shape of the sheet M read by the reading device 130.

Specifically, the deformation amount calculation unit 81 acquires, from the reading device 130, information indicating an outer shape of a sheet M bearing an image, serving as a preceding recording medium of a plurality of successive recording media. Then, the deformation amount calculation unit 81 calculates the amount of deformation of the sheet M based on the information thus acquired from the reading device 130. A detailed description with reference to FIGS. 10 and 12 of how to calculate the amount of deformation is deferred.

Based on the amount of deformation of the sheet M calculated by the deformation amount calculation unit 81, the image correction unit 82 corrects an image to be formed on a following sheet M serving as a following recording medium of the plurality of successive recording media. Then, the image correction unit 82 outputs data of the image thus corrected (i.e., corrected image) to the image forming device 120, to cause the image forming device 120 to form the corrected image on the following sheet M. A detailed description with reference to FIGS. 10 and 12 of how to correct the image is deferred.

Referring now to FIGS. 7 to 10, a description is given of a continuous printing process according to the first embodiment.

Figure 7:
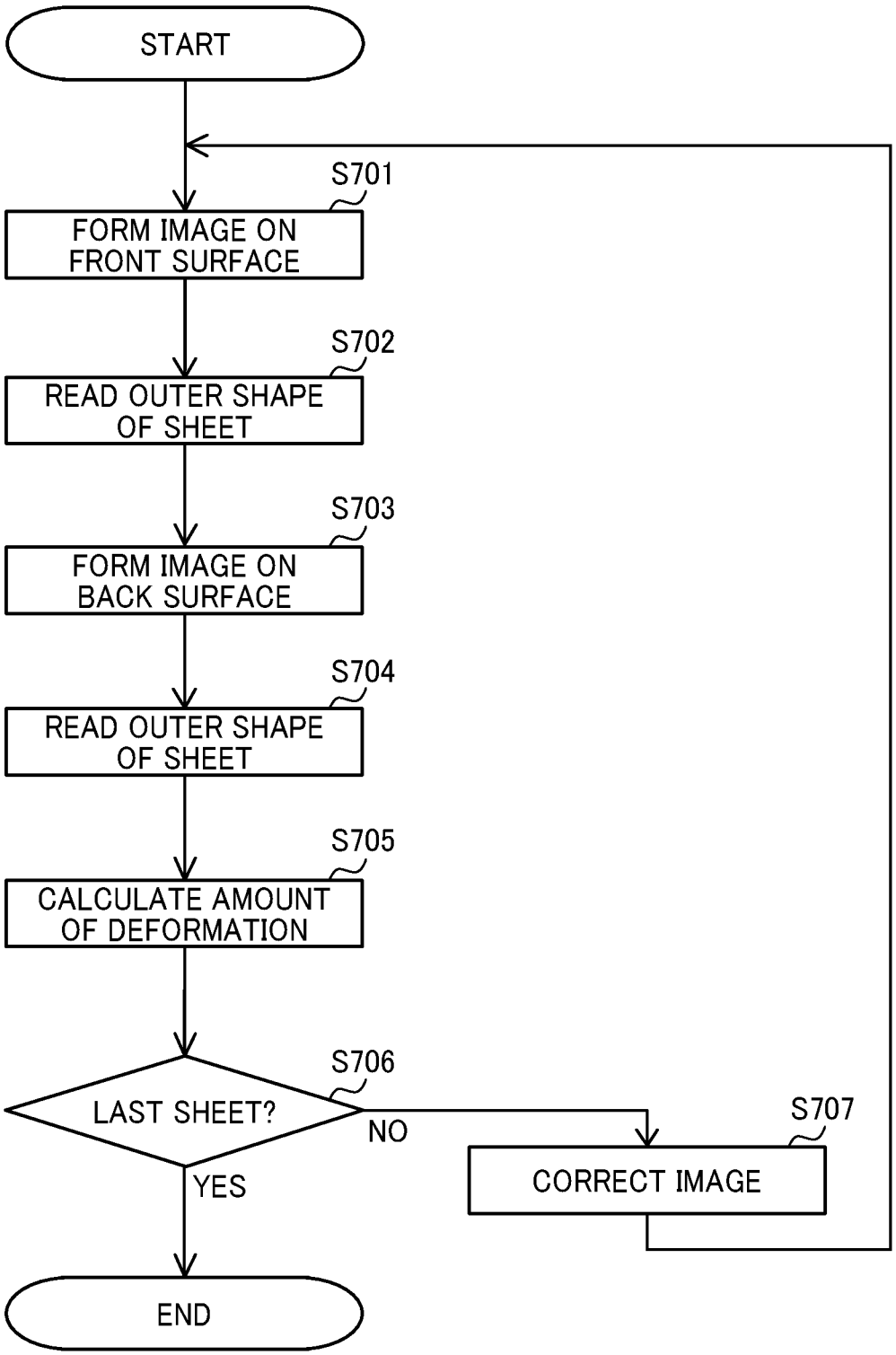
FIG. 7 is a flowchart of a continuous printing process.
Figure 8:
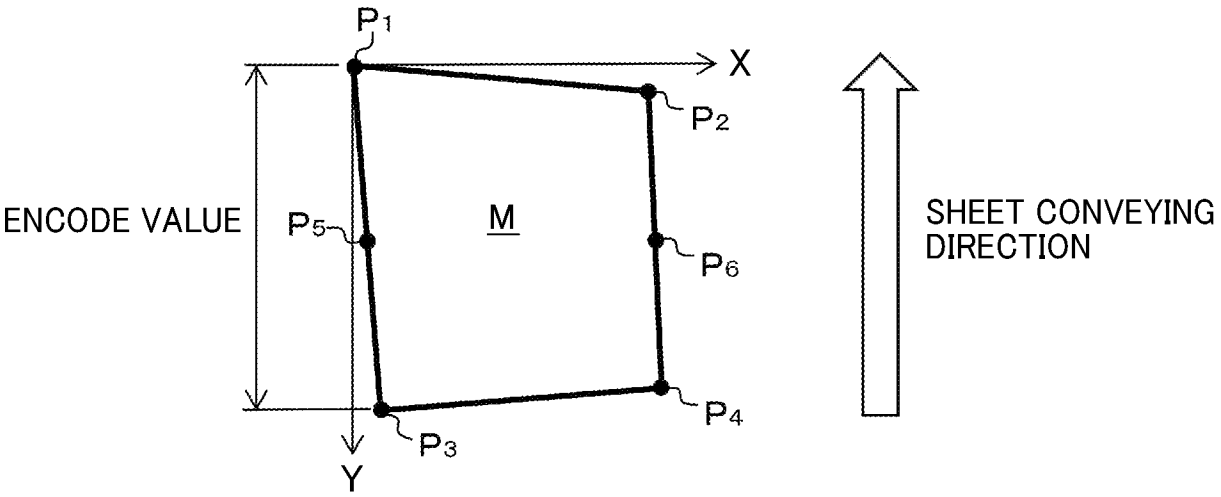
FIG. 8 is a diagram illustrating a procedure for reading an outer shape of a recording medium having an image on a front surface of the recording medium.
Figure 9:
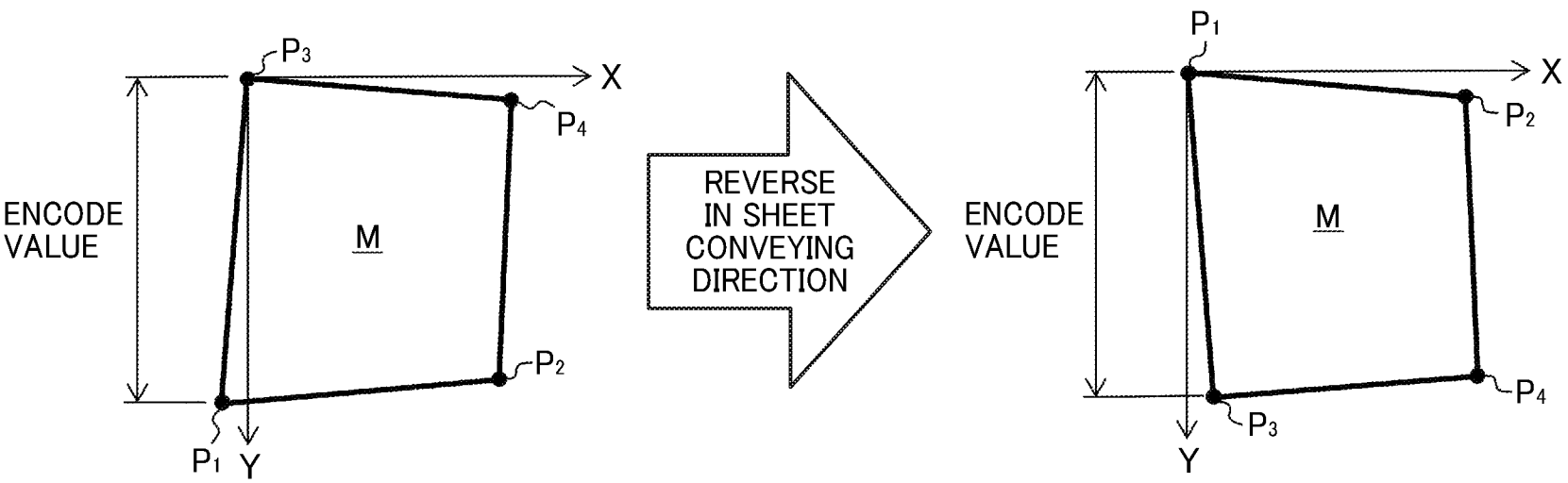
FIG. 9 is a diagram illustrating a procedure for reading an outer shape of a recording medium having images on front and back surfaces, respectively, of the recording medium.
Figure 10:
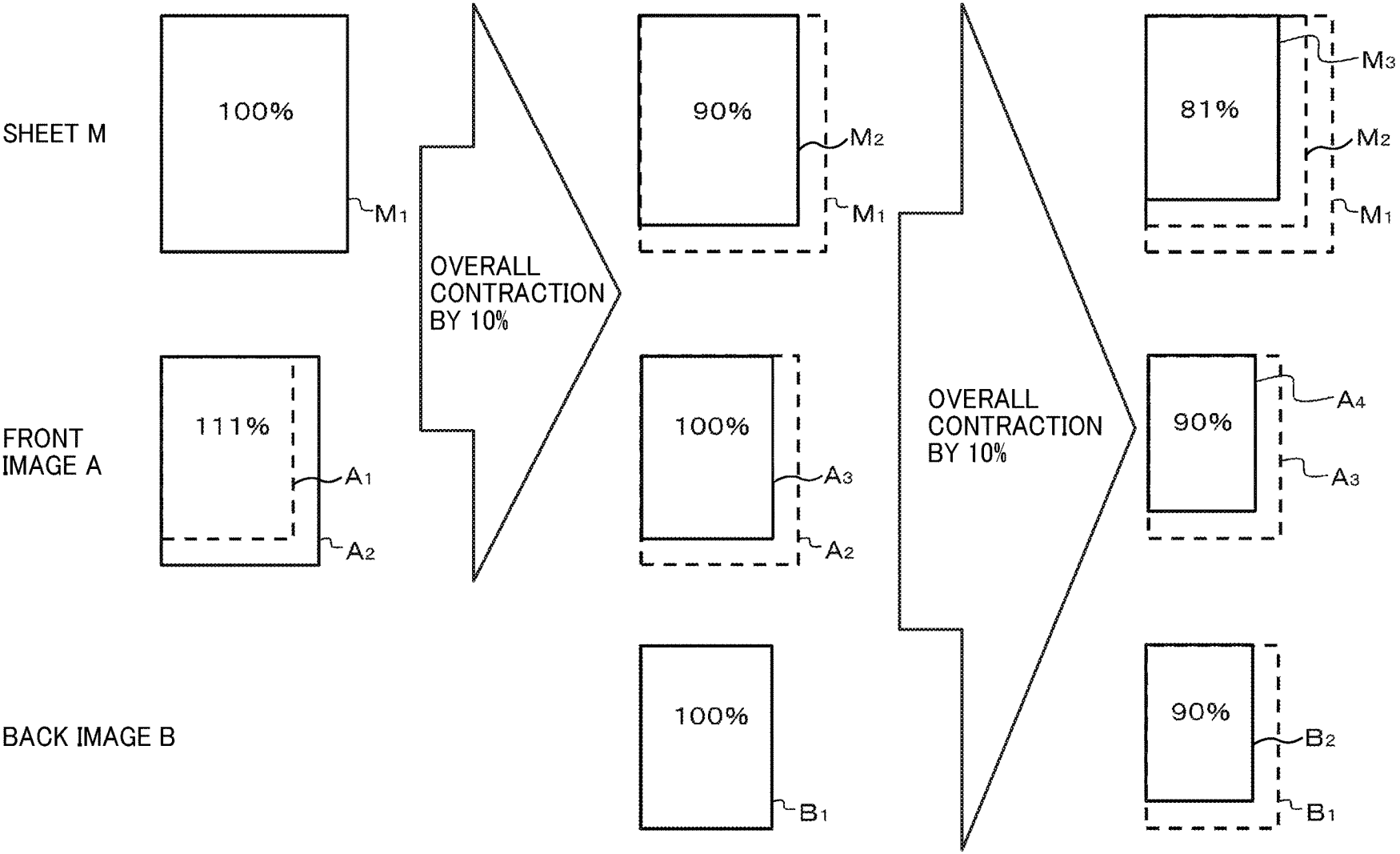
FIG. 10 is a diagram illustrating a relationship among a recording medium, a front image, and a back image according to the first embodiment of the present disclosure.

FIG. 7 is a flowchart of the continuous printing process. FIG. 8 is a diagram illustrating a procedure for reading an outer shape of a sheet M having an image on a front surface of the sheet M. FIG. 9 is a diagram illustrating a procedure for reading an outer shape of a sheet M having images on front and back surfaces, respectively, of the sheet M. FIG. 10 is a diagram illustrating a relationship among a sheet M, a front image A, and a back image B in a case in which only the front image A is corrected.

The continuous printing process is a process of sequentially forming images on a plurality of successive sheets M. The controller 80 starts the continuous printing process in response to, e.g., an instruction of continuous copying on the plurality of successive sheets M from an operator through the operation device 70 or an instruction of continuous printing on the plurality of successive sheets M from an external device such as a personal computer (PC). In the continuous copying or continuous printing, the operator, for example, designates the size and number of sheets M to be imaged and images to be formed on the front and back surfaces of each sheet M.

In step S701, the controller 80 forms an image on a front surface of a first sheet M of the plurality of successive sheets M. More specifically, the controller 80 causes the conveying device 110 to convey, through the main conveyance passage $R_1$, the sheet M from the input tray 101 to a position at which the sheet M faces the image forming device 120. The controller 80 then causes the image forming device 120 to form a designated front image A on the front surface of the sheet M thus conveyed.

The controller 80 then causes the conveying device 110 to further convey the sheet M bearing the front image A to a position at which the sheet M passes through the fixing roller pair 124, which fixes the front image A onto the sheet M. An outer shape of the sheet M changes while the front image A is fixed onto the sheet M. That is, the outer shape of the sheet M may change before and after passing through the fixing roller pair 124.

Therefore, the controller 80 causes the reading device 130 to read a first shape, which is an outer shape of a sheet M having an image fixed only onto a front surface of the sheet M. That is, in step S702, the controller 80 causes the reading device 130 to read, as the first shape, the outer shape of the sheet M bearing only the fixed front image A. The controller 80 then causes the RAM 20 to store information indicating the first shape read by the reading device 130 (e.g., coordinates of the vertices $P_1$ to $P_4$ described later).

The controller 80 causes the conveying device 110 to convey the sheet M along the main conveyance passage $R_1$ so that the sheet M passes through a position at which the sheet M faces the reading device 130. The controller 80 then causes the reading device 130 to read the outer shape of the sheet M passing in front of the reading device 130. For example, in a two-dimensional coordinate system in which an origin is the vertex $P_1$ at the leading left corner of a sheet M, an X axis indicates the sheet width direction perpendicular to the sheet conveying direction, and a Y axis indicates the sheet conveying direction as illustrated in FIG. 8, the reading device 130 may specify the coordinates of the vertices $P_2$, $P_3$, and $P_4$ from the vertex $P_1$ as the origin.

More specifically, the controller 80 specifies the distance, in an X-axis direction, between the vertex $P_1$ and each of the vertexes $P_2$, $P_3$, and $P_4$ based on a result of detection by the line sensor 131. In addition, the controller 80 specifies the distance, in a Y-axis direction, between the vertex $P_1$ and each of the vertexes $P_2$, $P_3$, and $P_4$ based on results of detection by the encoder 132 and the timing sensor 133.

Note that the points specified in step S702 are not limited to the vertices $P_1$ to $P_4$. As another example, the controller 80 may further specify the positions of vertices $P_5$ and $P_6$ illustrated in FIG. 8. An increase in the number of positions of points read enhances the accuracy of calculating the amount of deformation described later. However, in order to calculate an amount of deformation of a sheet M in one of the sheet conveying direction and the sheet width direction, the controller 80 may specify at least two points of an outer shape of the sheet M.

In step S703, the controller 80 forms an image on a back surface of the sheet M having the first shape read in step S702. More specifically, the controller 80 causes the conveying device 110 to convey the sheet M along the reverse conveyance passage $R_2$ to reverse the front and back surfaces of the sheet M and direct the sheet M thus reversed to the position at which the sheet M faces the image forming device 120. The controller 80 then causes the image forming device 120 to form a designated back image B on the back surface of the sheet M thus conveyed.

The controller 80 then causes the conveying device 110 to further convey the sheet M bearing the back image B to the position at which the sheet M passes through the fixing roller pair 124, which fixes the back image B onto the sheet M. The outer shape of the sheet M changes while the back image B is fixed onto the sheet M. That is, the outer shape of the sheet M may differ between the time when the front image A is formed on the sheet M and the time when the back image B is formed on the sheet M bearing the front image A.

Therefore, the controller 80 causes the reading device 130 to read a second shape, which is an outer shape of a sheet M having images fixed onto front and back surfaces, respectively, of the sheet M. That is, in step S704, the controller 80 causes the reading device 130 to read, as the second shape, the outer shape of the sheet M bearing both of the fixed front image A and the fixed back image B. The reading device 130 reads the second shape in a similar way to the way described above in step S702, and a redundant description thereof is herein omitted.

However, the position of the sheet M is reversed in the sheet conveying direction before and after passing through the reverse conveyance passage $R_2$. Therefore, as illustrated in FIG. 9, the controller 80 may specify the second shape of the sheet M by reversing, in the sheet conveying direction, the positions of the vertices $P_1$ to $P_4$ read by the reading device 130. Thereafter, the controller 80 causes the conveying device 110 to convey, along the main conveyance passage $R_1$, the sheet M having the second shape read, to finally eject the sheet M onto the output tray 102.

In step S705, the deformation amount calculation unit 81 of the controller 80 calculates an amount of deformation of the sheet M based on the outer shape of the sheet M read by the reading device 130 in steps S702 and S704. In the first embodiment, as illustrated in FIG. 10, for example, the sheet M is contracted by 10% when an image is fixed onto the front surface of the sheet M. Thereafter, the sheet M is further contracted by 10% when another image is fixed onto the back surface of the sheet M. Note that, in the first embodiment, the ratio between the length in the sheet conveying direction and the length in the sheet width direction is maintained before and after the deformation.

The deformation amount calculation unit 81 of the first embodiment compares an initial shape of the sheet M with the first shape read in step S702 to calculate a first-half magnification as an amount of deformation. The first-half magnification is a magnification of the first shape to the initial shape of the sheet M. The deformation amount calculation unit 81 then stores, in the RAM 20, the first-half magnification (=90%) thus calculated. Subsequently in step S706, the controller 80 determines whether an image is formed on a last sheet M in the continuous printing process. When the controller 80 determines that no image is formed on the last sheet M (NO in step S706), the controller 80 corrects a front image A to be formed on a front surface of a following sheet M of the plurality of successive sheets M (i.e., following recording medium of a plurality of successive recording media), based on the amount of deformation of a preceding sheet M (i.e., a preceding recording medium of the plurality of successive recording media) in step S707. In other words, the controller 80 corrects a front image A based on the amount of deformation of the preceding sheet M (i.e., preceding recording medium) in step S707, to cause the image forming device 120 to form the front image A thus corrected on the front surface of the following sheet M (i.e., following recording medium).

More specifically, as illustrated in FIG. 10, the image correction unit 82 of the controller 80 scales a designated front image $A_1$ by a reciprocal 111%) of the first-half magnification calculated in step S705, to generate a front image $A_2$ as a corrected front image A. A pixel interpolation algorithm may be used for image enlargement; whereas a pixel thinning algorithm may be used for image contraction. On the other hand, in the first embodiment, the image correction unit 82 does not correct a designated back image $B_1$.

The controller 80 then performs the operations on the following sheet M (i.e., following recording medium) in steps S701 to S705. In the first embodiment, the operations performed on the following sheet M (i.e., following recording medium) in steps S701 to S705 are substantially the same as the operations performed on the preceding sheet M (i.e., preceding recording medium) in steps S701 to S705, except that the front image $A_2$ is formed as a scaled front image A on the front surface of the following sheet M in step S701. Therefore, a redundant description thereof is herein omitted.

In the first embodiment, as illustrated in FIG. 10, the front image $A_2$ is formed as a corrected front image A on a front surface of a sheet $M_1$ having an initial shape in step S701. When the sheet $M_1$ bearing the front image $A_2$ passes through the fixing roller pair 124, the sheet $M_1$ is contracted by 10% similarly to the preceding sheet M (i.e., preceding recording medium), to be a sheet $M_2$ (=90%). At this time, the front image $A_2$ formed on the front surface of the sheet $M_1$ is also contracted by 10%, to be a front image $A_3$ ("=" 100%) on the sheet $M_2$.

Thereafter, the back image $B_1$ is formed on a back surface of the sheet $M_2$, resulting from contraction of the sheet $M_1$ by 10%. When the sheet $M_2$ bearing the back image $B_1$ passes through the fixing roller pair 124, the sheet $M_2$ is contracted by 10% similarly to the preceding sheet M (i.e., preceding recording medium), to be a sheet $M_3$ (=81%). At this time, the front image $A_3$ and the back image $B_1$ formed on the sheet $M_2$ are also contacted by 10%, to be a front image $A_4$ (≈90%) and a back image $B_2$ (≈90%), respectively, on the sheet $M_3$.

Thus, the front image A is enlarged to 111% and formed on the sheet M, which is contracted by 10% each time an image is formed. As a consequence, the front image A is contracted to 100% immediately before the back image B is formed. After the back image B uncorrected (=100%) is formed on the sheet M, the front image A and the back image B are contracted to be identical proportions (=90%).

The controller 80 repeats the operations performed in steps S701 to S707 for all the sheets M instructed. When the controller 80 determines that an image is formed on the last sheet M in the continuous printing process (YES in step S706), the continuous printing process ends.

Note that, in step S705 according to the first embodiment, the deformation amount calculation unit 81 overwrites, with a newly calculated first-half magnification, the first-half magnification already stored in the RAM 20. That is, in step S707 according to the first embodiment, the image correction unit 82 corrects an image to be formed on a second sheet M (i.e., a following recording medium right after a preceding recording medium of a plurality of successive recording media), based on an amount of deformation of the first sheet M on which an image is formed right before (i.e., the preceding recording medium right before the following recording medium of the plurality of successive recording media). In other words, the image correction unit 82 corrects an image based on an amount of deformation of the first sheet M, to cause the image forming device 120 to form the image thus corrected on the second sheet M.

A description is now given of some or all of advantages according to the first embodiment, enumeration of which is not exhaustive or limiting.

According to the first embodiment, the front image A is scaled so that the front image A fixed onto a sheet M and the back image B become identical in size. Thus, the front image A and the back image B are formed on the sheet M at identical positions and in identical sizes.

According to the first embodiment, the reading device 130 is disposed at a position where the sheet M passes immediately after the front image A is formed and immediately after the back image B is formed. Such positioning of the reading device 130 obviates the need that an operator places the sheet M on a scanner to cause the scanner to read the outer shape of the sheet M.

According to the first embodiment, the controller 80 corrects an image to be formed on a following sheet M (i.e., a following recording medium of a plurality of successive recording media), based on an amount of deformation of a preceding sheet M (i.e., a preceding recording medium of the plurality of successive recording media) in a continuous printing process. In other words, the controller 80 corrects an image based on an amount of deformation of a preceding sheet M (i.e., a preceding recording medium of a plurality of successive recording media), to cause the image forming device 120 to form the image thus corrected on a following sheet M (i.e., a following recording medium of the plurality of successive recording media) in a continuous printing process. Such correction obviates the need to output, e.g., a dedicated chart before actual printing and preventing a waste of sheets M.

According to the first embodiment, the amount of deformation is updated each time an image is formed on a sheet M. That is, an image is corrected based on the amount of deformation reflecting current external factors (e.g., temperature, humidity). Accordingly, the front image A and the back image B are formed accurately at identical positions and in identical sizes. Note that the preceding sheet M (i.e., preceding recording medium) and the following sheet M (i.e., following recording medium) are successive sheets M (i.e., successive recording media) on which images are formed in the same continuous printing process. Accordingly, even when an external factor (e.g., temperature, humidity) fluctuates during the continuous printing process, the front image A and the back image B are formed stably at identical positions and in identical sizes.

According to the first embodiment, the controller 80 calculates an amount of deformation based on an outer shape of a sheet M read by the reading device 130. That is, the first embodiment reduces the load of image processing related to the calculation of the amount of deformation, compared to a case in which the amount of deformation is calculated based on a read image on a sheet M. Accordingly, the front image A and the back image B are formed at identical positions and in identical sizes without reducing the throughput of the continuous printing process.

Now, a description is given of a second embodiment of the present disclosure.

In the first embodiment described above, only the front image A is corrected based on the first-half magnification. However, the operation performed in step S707 is not limited to the example in the first embodiment described above.

Figure 11:
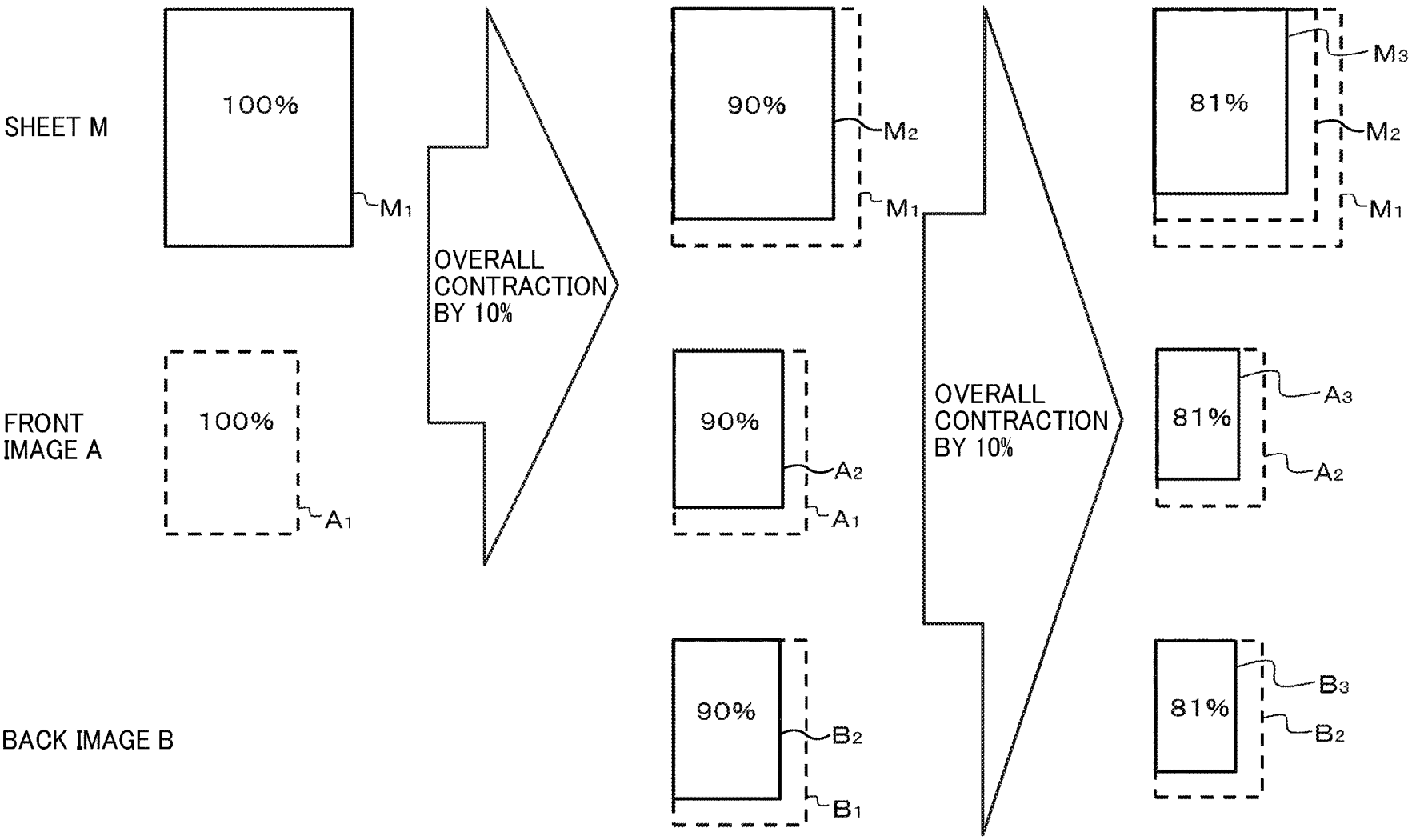
FIG. 11 is a diagram illustrating a relationship among a recording medium, a front image, and a back image according to a second embodiment of the present disclosure.

Specifically, with reference to FIG. 11, a description is now given of an operation performed in step S707 according to the second embodiment.

FIG. 11 is a diagram illustrating a relationship among a sheet M, a front image A, and a back image B in a case in which only the back image B is corrected.

Note that the configuration of the image forming apparatus 100 and the operations other than the operation performed in step S707 are substantially the same as those in the first embodiment, and redundant descriptions thereof are herein omitted.

The image correction unit 82 of the second embodiment does not correct a designated front image $A_1$ as illustrated in FIG. 11. The image correction unit 82 of the second embodiment scales a designated back image $B_1$ by the first-half magnification (=90%) calculated in step S705, to generate a back image $B_2$ as a corrected front image B.

In the second embodiment, as illustrated in FIG. 11, the front image $A_1$ is formed on a front surface of a sheet $M_1$ having an initial shape in step S701. When the sheet $M_1$ bearing the front image $A_1$ passes through the fixing roller pair 124, the sheet $M_1$ is contracted by 10% similarly to a preceding sheet M (i.e., a preceding recording medium of a plurality of successive recording media), to be a sheet $M_2$ (=90%). At this time, the front image $A_1$ formed on the front surface of the sheet $M_1$ is also contracted by 10%, to be a front image $A_2$ (=90%) on the sheet $M_2$.

Thereafter, the back image $B_2$ (=90%) is formed as a corrected back image B on a back surface of the sheet $M_2$ resulting from contraction of the sheet $M_1$ by 10%. When the sheet $M_2$ bearing the back image $B_2$ passes through the fixing roller pair 124, the sheet $M_2$ is contracted by 10% similarly to the preceding sheet M (i.e., preceding recording medium), to be a sheet $M_3$ (=81%). At this time, the front image $A_2$ and the back image $B_2$ formed on the sheet $M_2$ are also contacted by 10%, to be a front image $A_3$ (=81%) and a back image $B_3$ (=81%), respectively, on the sheet $M_3$.

Thus, the back image B is contracted to 90% and formed on the sheet M, which is contracted by 10% each time an image is formed. That is, the back image B thus formed is identical in size to the front image A contacted to 90% when the front image A is fixed onto the sheet M. Then, the front image A and the back image B of identical proportions (=90%) are contracted when the back image B is fixed onto the sheet M.

Note that, in the first embodiment and the second embodiment described above, the sheet M is scaled at the same ratios in the sheet conveying direction and the sheet width direction. Alternatively, however, the magnifications of the sheet M before and after the deformation may be different between the sheet conveying direction and the sheet width direction.

In such a case, the deformation amount calculation unit 81 may calculate the magnification of the sheet M in the sheet conveying direction and the magnification of the sheet M in the sheet width direction individually in step S705. The image correction unit 82 may scale an image in the sheet conveying direction and the sheet width direction individually in step S707. Other operations are substantially the same as the operations described above, and a redundant description thereof is herein omitted.

Amounts of deformation of the sheet M before and after images are fixed onto the sheet M may be different for each edge of the sheet M. As an example, before and after images are fixed onto the sheet M, left and right edges of the sheet M may be scaled at different magnifications. As another example, before and after images are fixed onto the sheet M, leading and trailing edges of the sheet M may be scaled at different magnifications.

Although either the front image A or the back image B is corrected in step S707 in the first embodiment and the second embodiment described above, both of the front image A and the back image B may be corrected. That is, the image correction unit 82 may correct at least one of the front image A and the back image B.

Now, a description is given of a third embodiment of the present disclosure.

Figure 12:
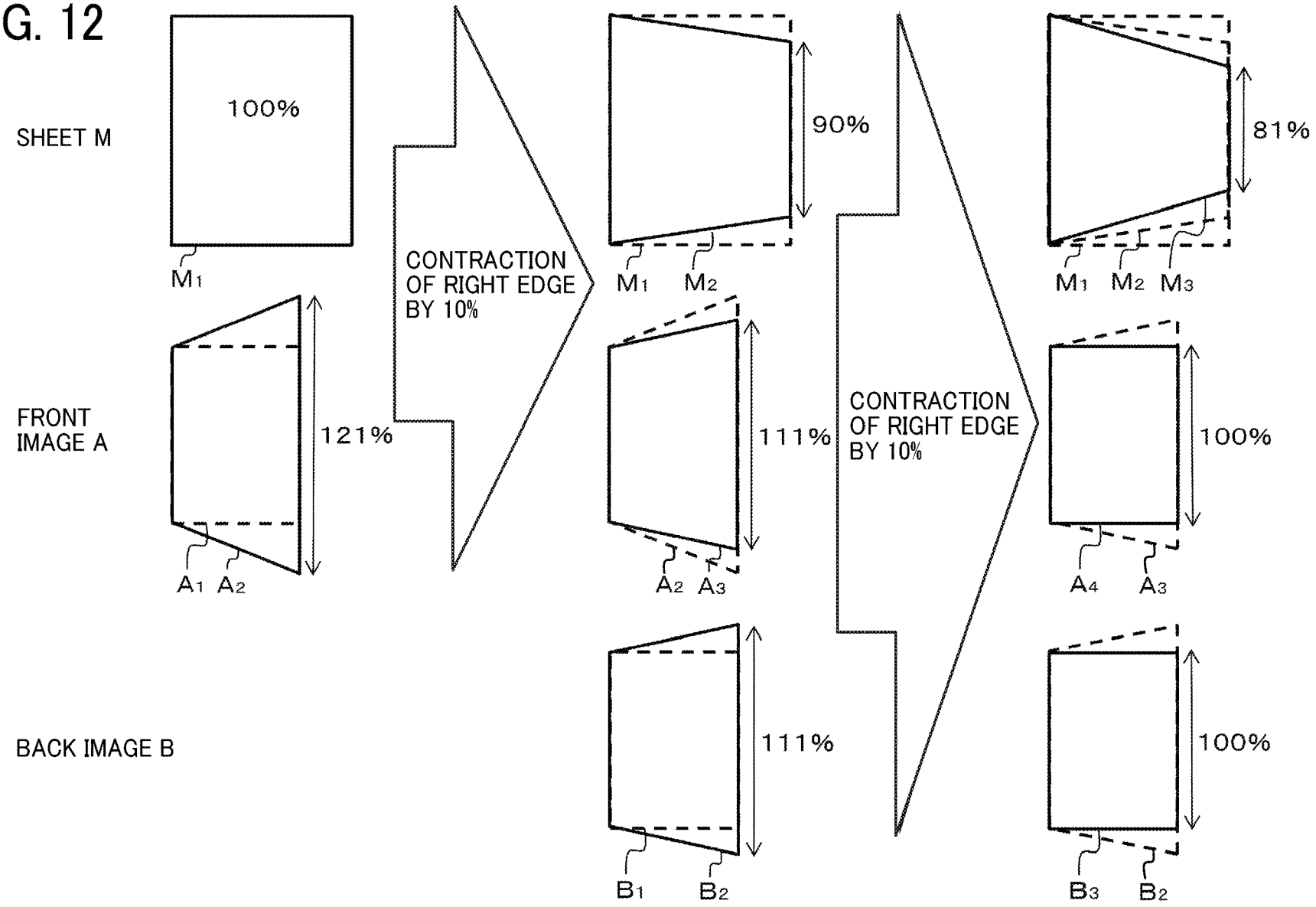
FIG. 12 is a diagram illustrating a relationship among a recording medium, a front image, and a back image according to a third embodiment of the present disclosure.

Specifically, with reference to FIG. 12, a description is now given of operations performed in steps S705 and S707 according to the third embodiment.

FIG. 12 is a diagram illustrating a relationship among a sheet M, a front image A, and a back image B in a case in which the front image A and the back image B are corrected.

Note that the configuration of the image forming apparatus 100 and the operations other than the operations performed in steps S705 and S707 are substantially the same as those in the first embodiment, and redundant descriptions thereof are herein omitted.

In the third embodiment, as illustrated in FIG. 12, for example, only a right edge of the sheet M is contracted by 10% when an image is fixed onto a front surface of the sheet M. Thereafter, only the right edge of the sheet M is further contracted by 10% when another image is fixed onto a back surface of the sheet M.

In step S705 according to the third embodiment, the deformation amount calculation unit 81 calculates, for each edge of the sheet M, an overall magnification and a latter-half magnification. The overall magnification is a magnification of the second shape to an initial shape of the sheet M. The latter-half magnification is a magnification of the second shape to the first shape of the sheet M. In the example illustrated in FIG. 12, the overall magnification of the right edge of the sheet M is 81%. The latter-half magnification of the right edge of the sheet M is 90%. The overall magnification and the latter-half magnification on other edges of the sheet M are 100%, respectively.

In step S707 according to the third embodiment, the image correction unit 82 corrects the front image A and the back image B of a following sheet M (i.e., a following recording medium of a plurality of successive recording media) individually. Specifically, the image correction unit 82 scales a front image $A_1$ by a reciprocal 121%) of the overall magnification to generate a front image $A_2$; whereas the image correction unit 82 scales a back image $B_1$ by a reciprocal 111%) of the latter-half magnification to generate a back image $B_2$.

In the third embodiment, as illustrated in FIG. 12, the front image $A_2$ is formed as a corrected front image A on a front surface of a sheet $M_1$ having an initial shape in step S701. When the sheet $M_1$ bearing the front image $A_2$ passes through the fixing roller pair 124, the right edge of the sheet $M_1$ is contracted by 10% similarly to a preceding sheet M (i.e., a preceding recording medium of the plurality of successive recording media). As a consequence the sheet $M_1$ becomes a sheet $M_2$ (=90%). At this time, a right edge of the front image $A_2$ formed on the front surface of the sheet $M_1$ is also contracted by 10%. As a consequence, the front image $A_2$ becomes a front image $A_3$ (≈111%) on the sheet $M_2$.

Thereafter, the back image $B_2$ (=111%) is formed as a corrected back image B on a back surface of the sheet $M_2$ resulting from contraction of the right edge of the sheet $M_1$ by 10%. When the sheet $M_2$ bearing the back image $B_2$ passes through the fixing roller pair 124, a right edge of the sheet $M_2$ is contracted by 10% similarly to the preceding sheet M (i.e., preceding recording medium). As a consequence, the sheet $M_2$ becomes a sheet $M_3$ (=81%). At this time, respective right edges of the front image $A_3$ and the back image $B_2$ formed on the sheet $M_2$ are also contacted by 10%. As a consequence, the front image $A_3$ and the back image $B_2$ become a front image $A_4$ (=100%) and a back image $B_3$ (=100%), respectively, on the sheet $M_3$.

Thus, the right edge of the front image A is enlarged to 121% and formed on the sheet M of which the right edge is contracted by 10% each time an image is formed. Thereafter, the right edge of the back image B is enlarged to 111% and formed on the sheet M of which the right edge is contracted by 10% each time an image is formed. That is, the front image A and the back image B are identical in size when the back image B is transferred onto the sheet M, that is, before the back image B is fixed onto the sheet M. Then, the respective right edges of the front image $A_3$ and the back image $B_2$ are contracted to identical proportions (=100%) when the back image B is fixed onto the sheet M.

Note that a combination of how the sheet M is formed and how to correct an image is not limited to the examples described above in the first embodiment to the third embodiment. That is, in the first embodiment and the second embodiment, both of the front image A and the back image B may be corrected. In the third embodiment, either the front image A or the back image B may be corrected.

In the first embodiment to the third embodiment described above, an image is corrected in step S707 based on a latest amount of deformation calculated in step S705. However, the time to calculate the amount of deformation is not limited to the examples described above. As another example, based on an amount of deformation of the first sheet M, the controller 80 may correct images to be formed on all the following sheets M in a continuous printing process.

The deformation amount calculation unit 81 may calculate an amount of deformation used in step S707 based on amounts of deformation of a plurality of preceding sheets M (i.e., a plurality of preceding recording media). As an example, in step S705, the deformation amount calculation unit 81 may store, in the RAM 20, an average of individual amounts of deformation of latest N number of preceding sheets M (i.e., preceding recording media) as the amount of deformation. Note that "N" is an integer of 2 or more. Such an operation reduces the influence of the deformation unique to individual sheets M.

In the embodiments described above, the image forming device 120 forms an image by electrophotography. Alternatively, however, the image forming device 120 may employ an inkjet printing system to form an image. In the inkjet printing system, the sheet M may expand and contract as the landed ink dries. That is, the embodiments of the present disclosure are applicable regardless of whether the image forming device 120 employs an electrophotographic printing system or an inkjet printing system.

According to the embodiments described above, an image forming apparatus easily and accurately adjusts and forms images on both surfaces of a recording medium.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

For example, the image forming apparatus according to an embodiment described above is a color image forming apparatus that forms color and monochrome images on recording media as illustrated in FIG. 1. Alternatively the image forming apparatus may be a monochrome image forming apparatus that forms monochrome images on recording media. In addition, the image forming apparatus to which the embodiments of the present disclosure are applied includes, but is not limited to, a printer, a copier, a facsimile machine, or a multifunction peripheral having at least two capabilities of these devices.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. An image forming apparatus comprising:

a conveying device configured to sequentially convey a plurality of successive recording media, the plurality of successive recording media including a preceding recording medium and a following recording medium conveyed after the preceding recording medium;

an image forming device configured to form an image on each of a front surface and a back surface of the preceding recording medium conveyed by the conveying device;

a reading device configured to read an outer shape of the preceding recording medium bearing the image formed by the image forming device; and control circuitry configured to:

calculate an amount of deformation of the preceding recording medium based on the outer shape of the preceding recording medium read by the reading device; and correct at least one of a front image and a back image of the following recording medium based on the amount of deformation calculated of the preceding recording medium, to cause the image forming device to form the front image and the back image on a front surface and a back surface, respectively, of the following recording medium.

2. The image forming apparatus according to claim 1, wherein the reading device is configured to read a first shape of the preceding recording medium having the image only on the front surface of the preceding recording medium, and wherein the control circuitry is configured to:

calculate, as the amount of deformation, a first-half magnification that is a magnification of the first shape to an initial shape of the preceding recording medium; and scale the front image of the following recording medium by a reciprocal of the first-half magnification.

3. The image forming apparatus according to claim 1, wherein the control circuitry is configured to:

calculate a magnification of the preceding recording medium in a direction of conveyance of the plurality of successive recording media and a magnification of the preceding recording medium in a width direction of the plurality of successive recording media perpendicular to the direction of conveyance of the plurality of successive recording media; and scale at least one of the front image of the following recording medium and the back image in the direction of conveyance of the plurality of successive recording media and the width direction of the plurality of successive recording media.

4. The image forming apparatus according to claim 1, wherein the control circuitry is configured to:

calculate a magnification for each edge of the preceding recording medium; and scale each edge of at least one of the front image and the back image of the following recording medium.

5. The image forming apparatus according to claim 1, wherein the reading device reads a first shape of the preceding recording medium having the image only on the front surface of the preceding recording medium, and wherein the control circuitry is configured to:

calculate, as the amount of deformation, a first-half magnification that is a magnification of the first shape to an initial shape of the preceding recording medium; and scale the back image of the following recording medium by the first-half magnification.

6. The image forming apparatus according to claim 1, wherein the reading device is configured to read:

a first shape of the preceding recording medium having the image only on the front surface of the preceding recording medium; and a second shape of the preceding recording medium having the image on each of the front surface and the back surface of the preceding recording medium, and wherein the control circuitry is configured to:

calculate, as the amount of deformation:

an overall magnification that is a magnification of the second shape to an initial shape of the preceding recording medium; and a latter-half magnification that is a magnification of the second shape to the first shape of the preceding recording medium; and scale:

the front image of the following recording medium by a reciprocal of the overall magnification; and the back image of the following recording medium by a reciprocal of the latter-half magnification.

7. The image forming apparatus according to claim 1, wherein the plurality of successive recording media includes a plurality of preceding recording media including the preceding recording media, and wherein the control circuitry is configured to calculate, as the amount of deformation, an average of individual amounts of deformation of the plurality of preceding recording media.

8. An image forming apparatus according to claim 1, further comprising an input tray and an output tray, wherein the conveying device is configured to:

convey the plurality of successive recording media along a main conveyance passage from the input tray to the output tray via the image forming device; and convey the plurality of successive recording media along a reverse conveyance passage branching from the main conveyance passage downstream from the image forming device in a direction of conveyance of the plurality of successive recording media, to reverse the front surface and the back surface of the plurality of successive recording media and direct the plurality of successive recording media to the image forming device, and wherein the reading device is disposed downstream from the image forming device in the direction of conveyance of the plurality of successive recording media on the main conveyance passage and upstream from a junction of the main conveyance passage and the reverse conveyance passage in the direction of conveyance of the plurality of successive recording media.

9. The image forming apparatus according to claim 1, wherein the preceding recording medium and the following recording medium are successive recording media on which images are formed in a continuous printing process.

* * * * *